US010247386B2

(12) United States Patent
Beaumont et al.

(10) Patent No.: US 10,247,386 B2
(45) Date of Patent: Apr. 2, 2019

(54) SYSTEM FOR VISUAL SIGNALLING

(71) Applicant: OBSTA, Sevres (FR)

(72) Inventors: Xavier Beaumont, Sevres (FR); Antoine Guichard, Sevres (FR); Heinrick Burgaud, Sevres (FR)

(73) Assignee: OBSTA, Sevres (FR)

( * ) Notice: Subject to any disclaimer, the term of this patent is extended or adjusted under 35 U.S.C. 154(b) by 0 days.

(21) Appl. No.: 15/534,898

(22) PCT Filed: Dec. 10, 2015

(86) PCT No.: PCT/FR2015/053414

§ 371 (c)(1),
(2) Date: Jun. 9, 2017

(87) PCT Pub. No.: WO2016/092216

PCT Pub. Date: Jun. 16, 2016

(65) Prior Publication Data

US 2018/0266655 A1 Sep. 20, 2018

(30) Foreign Application Priority Data

Dec. 12, 2014 (FR) ..... 14 62349

(51) Int. Cl.
*F21Y 103/10* (2016.01)
*F21W 111/06* (2006.01)
(Continued)

(52) U.S. Cl.
CPC ..... *F21V 5/043* (2013.01); *F21V 5/007* (2013.01); *F21W 2111/00* (2013.01);
(Continued)

(58) Field of Classification Search
CPC ..... B60Q 9/008; B63B 45/04; B64D 47/06; F21V 5/007; F21V 5/043; F21W 2111/06;
(Continued)

(56) References Cited

U.S. PATENT DOCUMENTS 7,712,931 B1 * 5/2010 Smith ..... B60Q 1/2611 362/308
2012/0257385 A1 10/2012 Peck
(Continued)

FOREIGN PATENT DOCUMENTS

EP 2565519 A1 3/2013
FR 2895779 A1 7/2007

OTHER PUBLICATIONS

International Search Report for PCT/FR2015/053414 Filed Dec. 10, 2015.

(Continued)

*Primary Examiner* — Zheng Song
(74) *Attorney, Agent, or Firm* — Notaro, Michalos & Zaccaria P.C.

(57) ABSTRACT

A light-signaling system includes three lighting modules, each including two projectors fixed together. Each projector includes an elongated cylindrical lens defined by a horizontal generatrix direction, and a linear light source parallel to the generatrix direction, for emitting a luminous flux. The cylindrical lens is capable of generating and projecting a main flat light beam within a predefined azimuthal angular sector that is greater than 60°. The two projectors of the same lighting module are arranged such that the generatrix direction of the first projector and the generatrix direction of the second projector form an angle of 120° the bisectrix of which defines the main direction of the lighting module.

7 Claims, 5 Drawing Sheets

(51) Int. Cl.

| | |
|---|---|
| ***F21V 5/04*** | (2006.01) |
| ***F21V 5/00*** | (2018.01) |
| *F21W 111/00* | (2006.01) |
| *F21Y 115/10* | (2016.01) |

(52) U.S. Cl.
CPC ..... *F21W 2111/06* (2013.01); *F21Y 2103/10* (2016.08); *F21Y 2115/10* (2016.08)

(58) Field of Classification Search
CPC ..... F21Y 2103/10; F21Y 2115/10; G02B 19/0028; G02B 19/0066
See application file for complete search history.

(56) References Cited

U.S. PATENT DOCUMENTS

| | | | | |
|---|---|---|---|---|
| 2013/0049980 | A1* | 2/2013 | Di Giovine ..... | F21V 29/004 340/815.45 |
| 2013/0155705 | A1 | 6/2013 | Peck | |
| 2014/0254189 | A1* | 9/2014 | Stein ..... | B60Q 1/2611 362/540 |
| 2014/0268855 | A1* | 9/2014 | Gerardo ..... | B60Q 1/2615 362/520 |
| 2014/0321108 | A1* | 10/2014 | Neal ..... | F21V 31/005 362/217.02 |
| 2017/0211763 | A1* | 7/2017 | Daubenspeck .... | G02B 19/0066 |

OTHER PUBLICATIONS

International Preliminary Report on Patentability or PCT/FR2015/053414 Filed Dec. 10, 2015.

* cited by examiner

SYSTEM FOR VISUAL SIGNALLING

TECHNICAL FIELD

The invention relates to the field of signaling devices, in particular for signaling tall obstacles, in particular chimneys, for example factory chimneys, to aircraft.

TECHNOLOGICAL BACKGROUND

Signaling devices intended for aircraft are used on chimneys. Such signaling devices may in particular include cylindrical lenses in order to emit focused light in a predefined direction, as illustrated by FR-A-2895779. Such signaling devices must be located between 1.5 and 3 meters below the top of a chimney in order to avoid potential interference by smoke or else on pylons of triangular cross section.

SUMMARY

Assuming that a chimney will be signaled by means of an isotropic cylindrical light beacon, then because of the geometry of the chimney it will be positioned on one side of the chimney. Under this assumption, the light emitted in the direction passing through the center of the chimney will be interrupted by the chimney itself. Thus, under this assumption, the chimney will not be signaled for the side opposite the side bearing the beacon. Moreover, the efficiency of the beacon is not optimum since the light emitted in the direction passing through the center of the chimney consumes power but is of no use.

One idea on which the invention is based is to provide a light-signaling system positioned below the top of a chimney and emitting light covering the entire airspace. One idea on which the invention is based is to provide a light-signaling system that is efficient in terms of useful emitted light.

According to one embodiment, the invention provides a light-signaling system comprising n lighting modules, for example three lighting modules, n being a positive integer greater than or equal to 2, in which:

each lighting module comprises m projector(s), for example two projectors, m being a positive integer greater than or equal to 1, said m projectors being, when the number m is strictly greater than 1, fixed together;

n and m being two integers the product of which is equal to 6;

each projector of the lighting module comprising:

an elongated cylindrical lens, the cylindrical shape of which is defined by a horizontal generatrix direction; and a linear light source parallel to the generatrix direction, extending over all or part of the length of the cylindrical lens in order to emit a luminous flux in the direction of the cylindrical lens;

the cylindrical lens being capable of generating a main flat light beam by concentrating the luminous flux within a predefined elevation angular sector around the horizontal generatrix direction in the direction of the space located on the opposite side of the cylindrical lens with respect to the light source, and being capable of projecting the main flat light beam within a predefined elementary azimuthal angular sector around the vertical direction, the predefined elementary azimuthal angular sector being greater than or equal to 60°;

each lighting module being configured to illuminate within an azimuthal angular sector smaller than or equal to the sum of the m elementary azimuthal angular sector(s) of each of the m projector(s);

the bisectrix of the azimuthal angular sector of each lighting module defining a main direction of the lighting module, the lighting modules being arranged such that the main directions of two adjacent lighting modules form between them an angle of 360°/n, for example an angle of 120° in the case of n being equal to 3, such that the light-signaling system is capable of emitting light around the light-signaling system in all azimuthal directions.

Stated otherwise, when the number m is equal to 1, the azimuthal angular sector of the lighting module is the elementary azimuthal angular sector of the sole projector including the lighting module.

In the case of n being equal to 3 and m being equal to 2, the invention provides a light-signaling system comprising three lighting modules, in which:

each lighting module comprises two projectors fixed together;

each projector of the lighting module comprising:

an elongated cylindrical lens, the cylindrical shape of which is defined by a horizontal generatrix direction; and a linear light source parallel to the generatrix direction, extending over all or part of the length of the cylindrical lens in order to emit a luminous flux in the direction of the cylindrical lens;

the cylindrical lens being capable of generating a main flat light beam by concentrating the luminous flux within a predefined elevation angular sector around the horizontal generatrix direction in the direction of the space located on the opposite side of the cylindrical lens with respect to the light source, and being capable of projecting the main flat light beam within a predefined azimuthal angular sector around the vertical direction, the predefined azimuthal angular sector being greater than or equal to 60°, the two projectors of the same lighting module being arranged such that the generatrix direction of the first projector and the generatrix direction of the second projector form a minimum angle of 120° around the vertical direction in the space located on the side of the light source;

the bisectrix of the angle defining a main direction of the lighting module;

the lighting modules being arranged such that the main directions of two adjacent lighting modules form between them an angle of 120°, such that the light-signaling system is capable of emitting light around the light-signaling system in all azimuthal directions. By virtue of these features, the signaling system emits light in all azimuthal directions.

By virtue of these features, the directional flat light beam is not obstructed by the support.

According to embodiments in which n is a positive integer greater than or equal to 2 and m is a positive integer greater than or equal to 1, such a light projector may include one or more of the following features.

According to one embodiment, the azimuthal angular sector of the main flat beam of a projector is defined as the angular sector in which the luminous intensity is higher than 50% of the intensity present at the center of the main flat light beam.

According to one embodiment in which m is greater than or equal to 2, two adjacent projectors of each lighting module are fixed together at a respective longitudinal end of the two projectors.

According to one embodiment, the m projectors, for example the two projectors, of each lighting module are positioned on a horizontal baseplate.

According to one embodiment, each lighting module comprises a housing fixing the m projectors, for example the two projectors, together. By virtue of these features, installation is facilitated since a lighting module may be fixed to the top of a support only once instead of having to fix each of the projectors separately.

According to one embodiment in which m is equal to 2, the housing is horizontally substantially triangular in shape, two sides of the triangle each being defined respectively by the respective generatrix direction of one of the two projectors fixed to the housing and the third side being capable of being fixed to a support. By virtue of these features, the azimuthal orientation of the projectors is predefined, thereby facilitating the installation of the lighting module.

According to one embodiment, the elevation angular sector is defined as the angular sector in which the luminous intensity is higher than 50% of the luminous intensity at the center of the flat light beam, the elevation angular sector in which the main flat beam is located being smaller than 10°, preferably smaller than 3°. By virtue of these features, the system emits light intended for signaling the support to aircraft without disturbing residents.

According to one embodiment, n minus 1 of the lighting modules, for example two of the lighting modules, are defined as secondary modules and the nth lighting module, for example the third lighting module, is defined as the main module, each of the secondary modules is connected by a power supply cable to the main module, the main module itself being connected to a main power supply cable that is capable of being connected to an electrical power supply in order to supply the projectors of each lighting module with power. By virtue of these features, the modular system may be installed at the top of the support without requiring a triplicate setup in terms of electrical cables.

The projectors and/or the lighting modules may be installed at different altitudes on the support.

According to one embodiment, the generatrix directions of all of the cylindrical lenses of the system are in one and the same horizontal plane.

According to one embodiment, each of the n lighting modules, for example the three lighting modules, is fixed to a tall obstacle that must be signaled, the three lighting modules being oriented so as to emit light around the obstacle.

According to one embodiment, an additional lighting module is stacked vertically on top of each of the n lighting modules, for example the three lighting modules. By virtue of these features, the luminous intensity emitted by the system may be amplified so that the signal is carried further around the support.

By virtue of these features, the luminous intensity emitted by the projector outside the main flat beam may be decreased. For example, the luminous intensity at a −10° angle of elevation is decreased to less than 3% of the luminous intensity emitted at the 0° angle of elevation, which corresponds, for example, to the horizontal.

BRIEF DESCRIPTION OF THE FIGURES

The invention will be better understood and other objects, details, features and advantages thereof will become more clearly apparent in the course of the following description of multiple particular embodiments of the invention, given solely by way of non-limiting illustration, and with reference to the appended drawings.

DETAILED DESCRIPTION OF EMBODIMENTS

Figure 1:
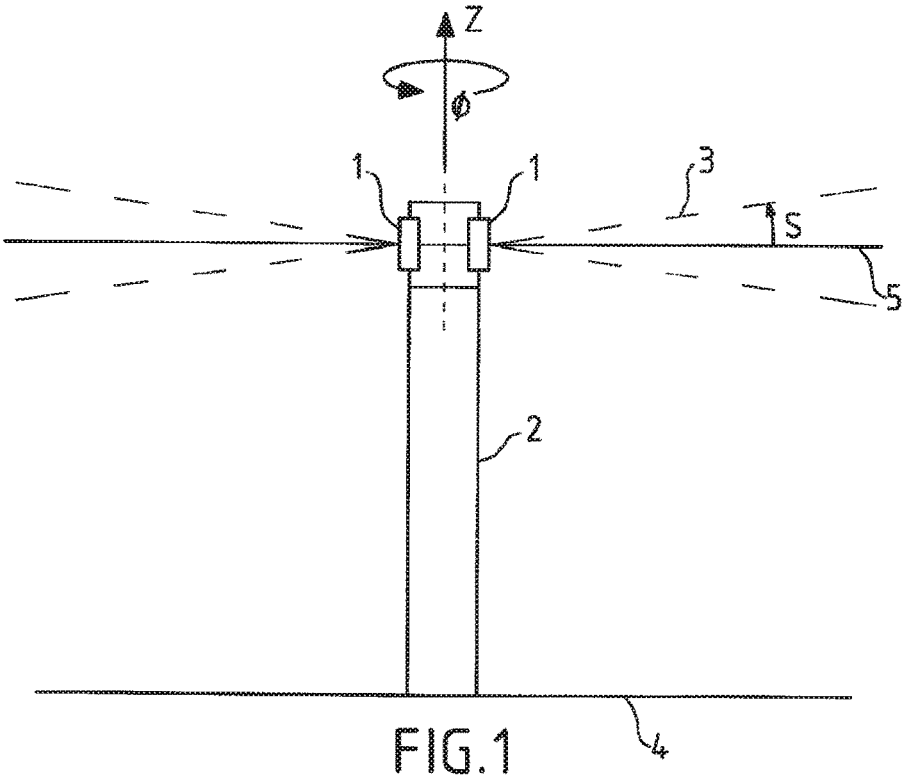
FIG. 1 is a diagram of a light-signaling system mounted on a pole with a vertical axis z.

With reference to FIG. 1, a light-signaling system 1 mounted on a chimney 2 with a vertical axis Z built on the ground 4 is shown. The light-signaling system 1 is installed below the top of the chimney 2. The light-signaling system 1 emits a flat light beam 3 all around the vertical axis, which corresponds to an azimuthal angular sector Φ of 360°. The flat light beam 3 is represented by dashes. The flat light beam 3 is concentrated within an elevation angular sector with an angle of elevation S centered on a center direction, which is, for example, a plane 5 that is horizontal or slightly inclined with respect to the horizontal. The luminous intensity of the flat light beam 3 is, for example, 20,000 cd of white light by day and/or 2000 cd of red or white light by night. The luminous intensity and the colour may be adjusted according to the time of day or night. This light-signaling system 1 allows in particular the chimney 2 to be signalled to aircraft.

Figure 2:
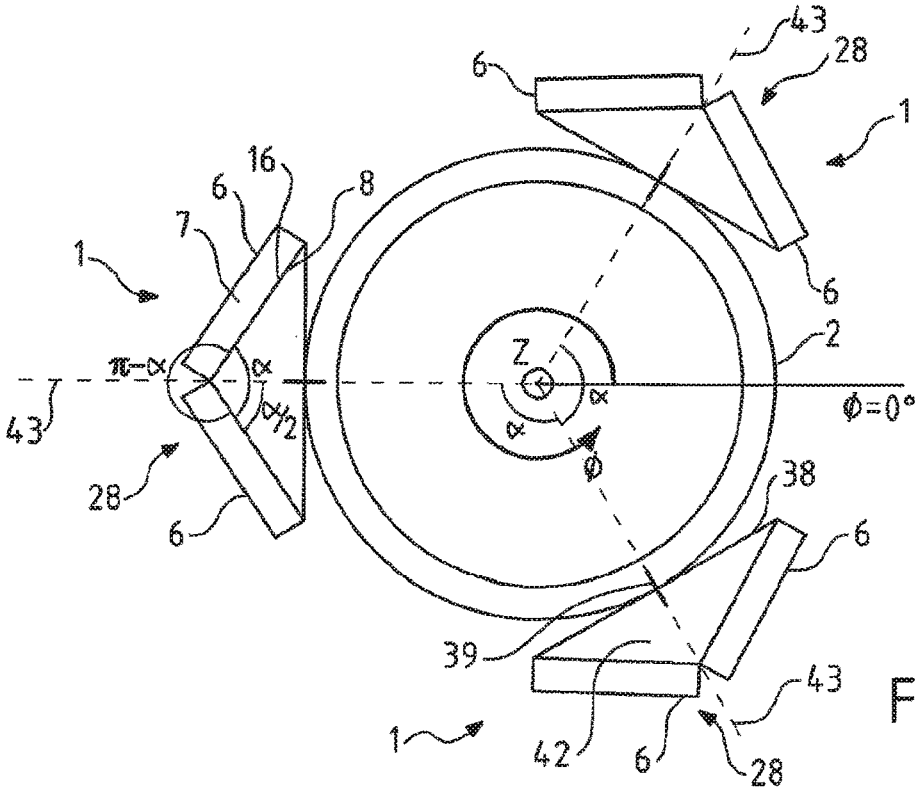
FIG. 2 is a view from above of an embodiment of the light-signaling system which comprises three modules of two projectors each.

In one illustrative example, with reference to FIG. 2, the light-signaling system 1 is shown in greater detail. Such a light-signaling system includes three modules 28 each comprising a support 38 bearing two projectors 6. The modules 28 are fixed to the chimney 2 by fastening means 39, for example screws. The three modules 28 are arranged in a plane perpendicular to the axis z. Each projector 6 includes a linear light source 8. On one and the same module 28, the two projectors 6 form an angle a that is equal to 120°. Each projector 6 emits an elementary flat light beam within a defined azimuthal angular sector. The minimum azimuthal angular sector of each of the six projectors 6 is 360° divided by the number of projectors 6. The light-signaling system comprises six projectors 6 in all, hence the minimum azimuthal angular sector is 60°, i.e. 360°/6. Each lighting module 28 emits a directional flat light beam corresponding to the addition of the elementary flat light beams of the two projectors 6 which it comprises. Thus, each lighting module 28 emits a directional flat light beam within an angular sector of 120°. The light-signaling system therefore emits a directional flat light beam over 360° corresponding to the addition of the elementary flat light beams of each module 28 of the light-signaling system 1. Thus, the main directions 43 of the azimuthal angular sectors of the flat light beams emitted by the lighting modules 28 must be offset from one another by a sufficient angle so that the totality formed by the flat light beams emitted by each of the projectors 6 of the light-signaling system 1 is emitted over a total azimuthal angle Φ of 360°. The main directions 43 of the lighting modules 28 are offset from one another by an angle $\alpha$=120°, as will be described below with reference to FIG. 9.

The assembly formed by the diode strip 16 and the cylindrical lens 7 is protected, for each projector, by an opaque metal housing 8 that is open in the direction of emission of the light. The opening of the housing 8 may be covered by a glass cover that does not bend the light, in order to protect the cylindrical lens from dust. This housing 8 is fixed in a dedicated site on a lighting module housing 42. In this illustrative example, the linear light source of the projector 6 is a strip of light-emitting diodes 16 placed in parallel to a cylindrical optics 7.

Figure 3:
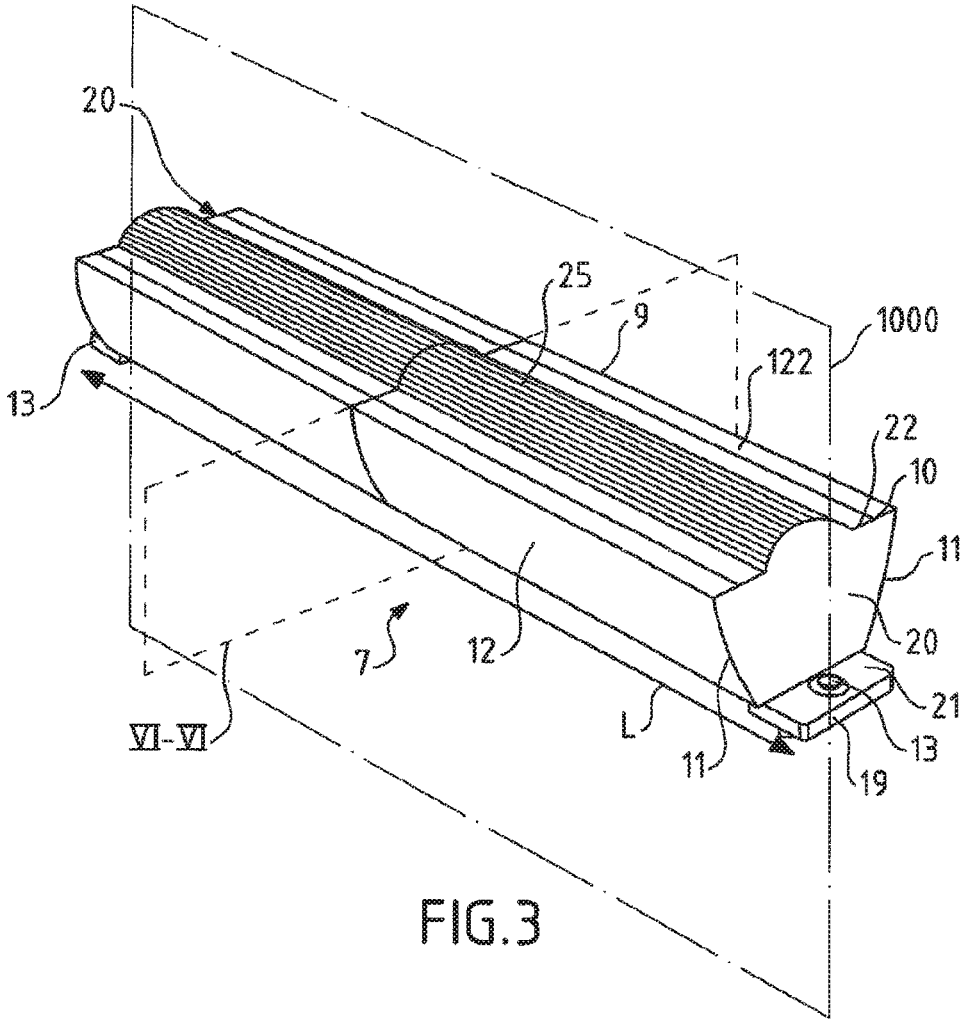
FIG. 3 is a perspective view of the cylindrical optics of a projector of the light-signaling system according to one embodiment.

In one illustrative example, with reference to FIG. 3, a cylindrical lens 7 of a projector 6 is shown. The cylindrical lens 7 has a length L. The cylindrical shape is defined by a horizontal generatrix direction 9 and by a directrix curve 10. The cylindrical lens 7 includes two end faces 20 which are perpendicular to the generatrix 9 of the cylinder. The cylindrical lens 7 consists mainly of polycarbonate. In this illustrative example, the cylindrical lens 7 measures around 200 mm. The overall shape of the directrix curve 10 is substantially that of a trapezoid. The large base 22 of the trapezoid measures around 56 mm and the small base 21 of the trapezoid measures around 25 mm. The sides 11 of the trapezoid define two inclined convex outer surfaces 12 of the cylindrical lens. The shape of the directrix curve 10 will be described below in greater detail with reference to FIG. 6. The cylindrical lens 7 possesses apertures 13 on a support 19. The apertures 13 are intended to receive fastening means fixing the cylindrical lens 7 to a strip of diodes 16 such as shown in FIG. 4.

In this illustrative example, the diode strip 16 includes diodes 14, 15 which are aligned linearly on a plate 17 so as to form a linear light source. The diodes of the strip 16 are red diodes 14 spaced successively apart from one another by four respective white diodes 15. The strip 16 also possesses apertures 18 so as to be able to be fixed to the support 19 of the cylindrical lens illustrated in FIG. 3 by superposing the apertures 13 present on the support 19.

Figure 4:
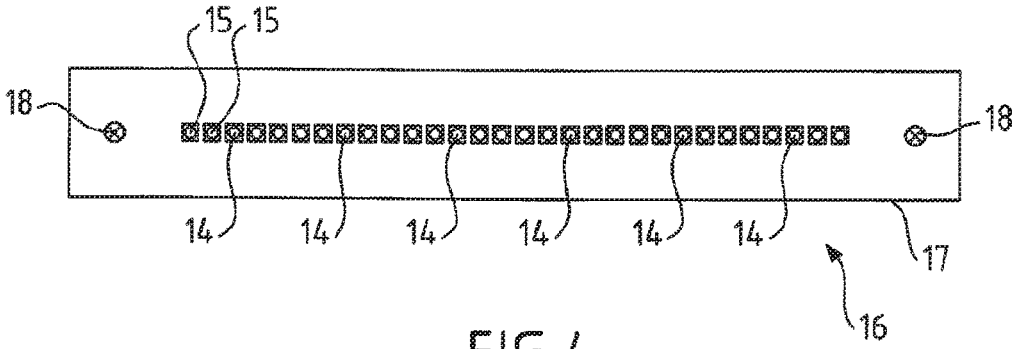
FIG. 4 is a view from above of a strip of LEDs which is fixed to the cylindrical optics of the projector shown in FIG. 3.
Figure 5:
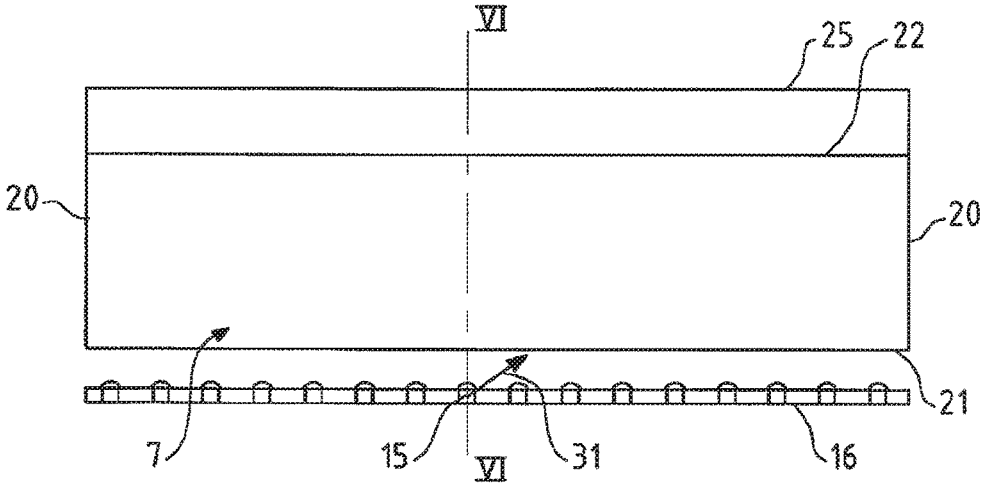
FIG. 5 shows, from the front, the assembly of the cylindrical optics of the projector and the strip of LEDs shown in FIGS. 3 and 4, respectively.

FIG. 5 shows a diagram of the assembly of the cylindrical lens 7 shown in FIG. 3 and of the strip of diodes 16 shown in FIG. 4. The strip of diodes 16 is fixed to the cylindrical lens 7 such that the surface of the cylindrical lens 7 defined by the small base 21 of the trapezoid is facing the face of the strip of diodes 16 which transmits the light. The direction 31 illustrates one of a number of directions of emission of the light by a diode 15. Indeed, the diode 15 emits light in all of the directions of the half-space delimited by the plane of the strip of diodes 16. The light emitted within an azimuthal angular sector which passes through the cylindrical optics 7 then exits within a minimum azimuthal angular sector of 60°.

The following figures show the structure of an operational projector 6 in greater detail, the projector 6 comprising the cylindrical lens 7 such as shown in FIG. 3 and the strip of diodes 16 such as shown in FIG. 4. The projector 6 is operational when the diodes 14, 15 of the strip of diodes 16 emit light.

Figure 6:
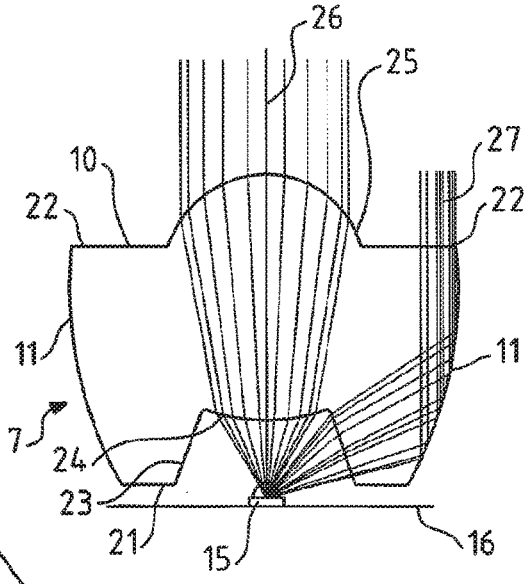
FIG. 6 is a cross section along the plane VI-VI of the assembly shown in FIG. 5, in which the trajectories of the light beams arising from one LED through the cylindrical optics are shown.

FIG. 6 is a cross section along the plane VI-VI of the assembly shown in FIG. 5, in which the trajectories of the light beams arising from the diode 15 through the cylindrical optics are shown. The small base 21 of the trapezoid is oriented toward the diode 15. The large base 22 of the trapezoid is oriented in the direction of the flat light beam. The directrix curve 10 exhibits a recess 23 on the small base 21 of the trapezoid. This recess defines a groove parallel to the generatrix 9 on the cylindrical lens 7. The bottom wall of the groove is a convex surface 24 so as to cause the rays arising from the strip of diodes 16 to converge to form the elementary flat light beam. In the cross-sectional plane VI-VI, the rays 26 arising from the diode 15 within an elevation angular sector centered roughly on the direction perpendicular to the strip 16 are therefore coupled at the convex interface 24 and concentrated by a second convex interface 25 located on the large base 22 of the trapezoid, after propagating through the cylindrical lens substantially perpendicularly to the generatrix 9. The light rays 26 thus exit the cylindrical lens 7 within an elevation angular sector centered roughly on the direction perpendicular to the strip 16. Stated otherwise, the cylindrical lens acts as a collimator.

The light rays 27 arising from the diode 15 in the plane VI-VI and in the direction at 45° with respect to the perpendicular to the strip 16 are themselves coupled by the lateral edges of the recess 23 and guided toward the sides 11 of the trapezoid. The surfaces of the two sides 11 reflect the light rays due to the incidence of the light rays on these surfaces. The reflected rays are thus guided in the direction that is roughly perpendicular to the strip 16, such that they exit the lens 7 via the large base 22 of the trapezoid, passing through a non-convex interface, within an elevation angular sector centered roughly on the direction perpendicular to the strip 16.

Thus, in the cross-sectional plane VI-VI, the light rays 26 and 27 exit the cylindrical lens 7 within a predefined elevation angular sector centered substantially on the direction perpendicular to the strip 16. These rays 26 and 27 define an elementary flat light beam.

The directrix curve has an axis of symmetry 100 perpendicular to the strip 16 such that the cylindrical lens 7 has a first plane of symmetry 1000 formed by two generatrices. Stated otherwise, the shape of the directrix curve 10 is substantially that of an isosceles trapezoid. The cylindrical lens 7 also has a second plane of symmetry, which is the cross-sectional plane IV-IV, sectioning the cylindrical lens at mid-length L/2. Specifically, the two end faces 20 are perpendicular to the generatrix of the cylinder.

Figure 7:
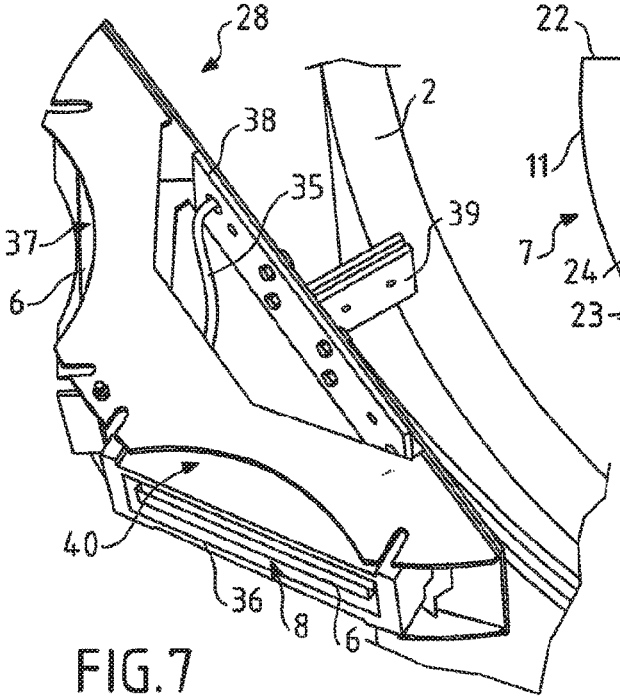
FIG. 7 shows a three-dimensional view of a lighting module comprising two projectors mounted on a lighting module housing.

FIG. 7 shows a lighting module 28 fixed to a chimney 2 in greater detail. The lighting module is composed of a lighting module housing 42. Two housings 8 containing a projector 6 are set into and fixed in the two respective dedicated sites 37 and 40 on the lighting module housing 42. The shape of the housing of the lighting module is substantially triangular when viewed from above. The two sites 37 and 40 dedicated to accommodating projectors 6 define two sides of the triangle. The third side 38 is useful for allowing the main direction 43 of the lighting module 28 to be oriented with respect to the chimney 2. Specifically, the main direction 43 is perpendicular to this third side 38 owing to the geometry of the triangle, which is isosceles. Specifically, the two projectors 6 are of the same length, in order to facilitate mass production and installation. Moreover, the main direction 43 is the bisectrix of the triangle, resulting in the sum of the azimuthal sectors of emission of each projector 6 covering an azimuthal sector of emission centered on this main direction 43. The lighting module 28 also comprises a fastening system 39 intended to be fixed to the chimney 2, for example by screws. An electrical power supply cable 35 is connected to the lighting module 28 in order to supply the light sources 16 of the projectors 6 with power.

Figure 8:
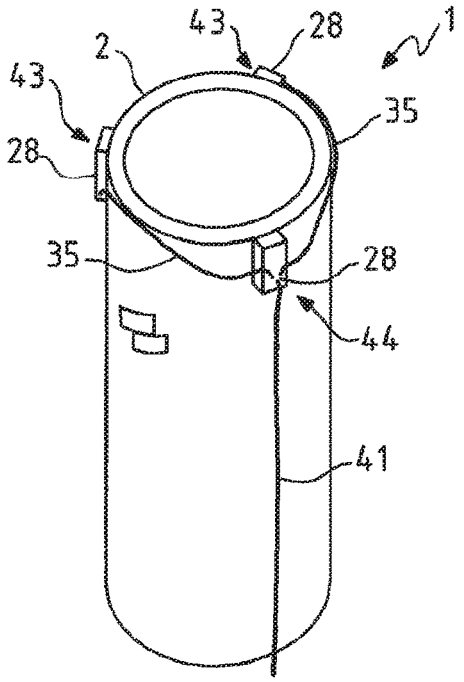
FIG. 8 schematically shows a light-signaling system mounted on a chimney according to one embodiment of the invention.

With reference to FIG. 8, the light-signaling system 1 is shown. Two of the lighting modules 28 are defined as secondary modules 43 and the third lighting module is defined as the main module 44. Each of the secondary modules 43 is connected by a power supply cable 35 to the main module 44. The main module is connected to a main power supply cable 41 which is itself connected to a remote electrical power supply, at the base of the chimney 2. These electrical cables 35, 41 allow the light sources of the projectors 6 of each lighting module 28 to be supplied with power. The advantage of such cabling is to facilitate the installation of the light-signaling system 1 at the top of the chimney 2. Indeed, the three lighting modules 28 require only one main power supply cable 41 in order to supply them all with power. A second advantage of such a system is that it allows the electrical power supply to be maintained on the ground.

Figure 9:
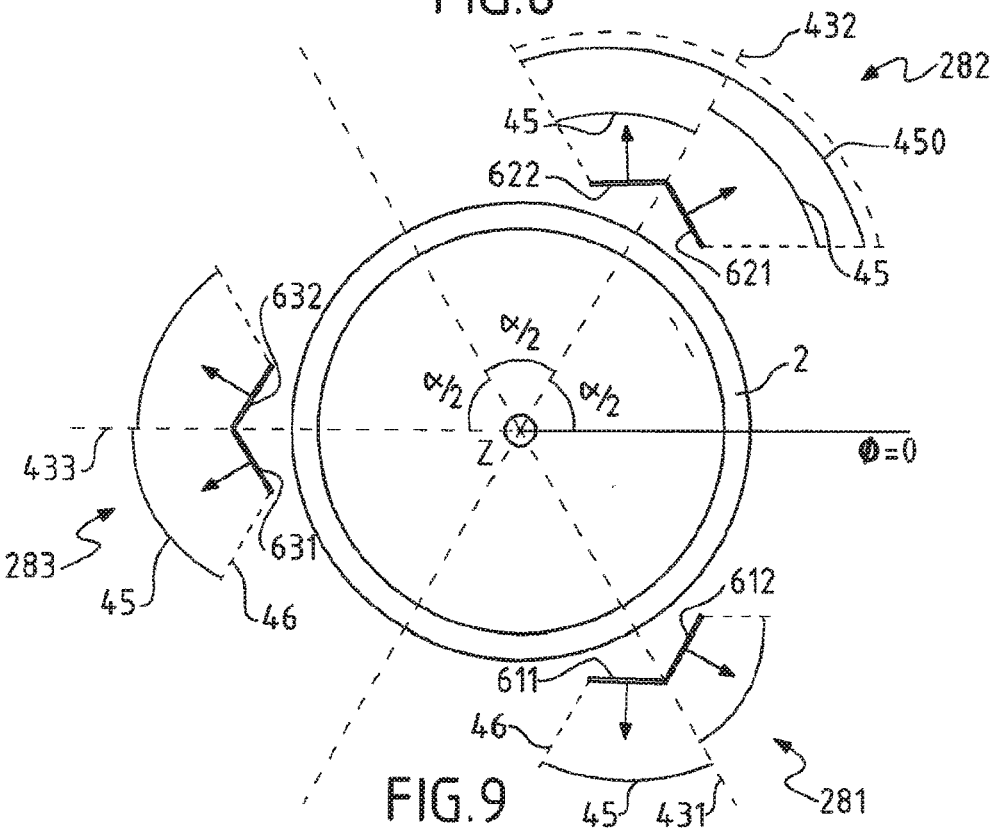
FIG. 9 schematically shows the azimuthal angular sectors of the projectors of the light-signaling system which comprises three modules of two projectors each.

With reference to FIG. 9, the geometry of the signaling system 1 described above is explained. The main directions 431, 432 and 433 of the three modules are represented by dotted lines and separated from one another by an angle $\alpha=120°$. The angular sectors of the elementary flat beams emitted by the projectors 611, 612, 621, 622, 631 and 632 are at least equal to 60°. For a first projector 611 of the lighting module 281, the minimum angular sector 45 is delimited by the main direction 431 of the lighting module 281 and by a parallel 46 to the main direction 432 of the lighting module 282 adjacent to the second projector 612 of the lighting module 281. The first projector 631 of the lighting module 283 adjacent to the first projector 611 of the lighting module 281 emits light within a minimum angular sector 45. This minimum angular sector 45 is delimited by a parallel 46 to the main direction 432 of the lighting module 282 adjacent to the second projector 632 of the lighting module 283 and by a parallel 46 to the main direction 433 of the lighting module 283. Two adjacent projectors 621 and 622 of the same lighting module 282 each emit light within a respective minimum elementary angular sector 45. This minimum elementary angular sector 45 is delimited by the main direction 432 of the lighting module 282 on the right for the minimum elementary angular sector 45 of the second projector 622 and on the left for the minimum elementary angular sector 45 of the first projector 621. Thus, the lighting module 282 emits light within an angular sector 450 that is equal to the sum of the two elementary angular sectors 45 of each of the projectors 621 and 622, since the two angular sectors 45 have only one shared direction 432. Likewise, two adjacent modules 282 and 281 emit within a minimum angular sector that is equal to the sum of the minimum angular sectors of emission of each of the two modules 282 and 281 since the minimum angular sectors of the two modules have only one shared direction of emission which is parallel to the main direction of emission 433 of the third lighting module 283. All of the features described in this paragraph apply to each of the lighting modules 281, 282 and 283.

Thus, owing to the invariance of the light-signaling system 1 with respect to rotation through an angle $\alpha=120°$ and owing to the minimum angular sector 450 of each of the three lighting modules 281, 282 and 283 being equal to $\alpha=120°$, the light-signaling system 1 is capable of emitting light in all spatial directions, i.e. over an azimuthal angular sector of $\Phi=360°$.

In one preferred embodiment, the angular sectors of the three lighting modules 281, 282 and 283 are each equal to the minimum angular sector which is equal to $\alpha=120°$, such that the angular sectors of the three lighting modules 281, 282 and 283 do not overlap. This embodiment addresses energy saving concerns, while allowing illumination without a blind spot in all azimuthal directions. In other embodiments, the angular sector of each of the three lighting modules 281, 282 and 283 is greater than $\alpha=120°$, such that the angular sectors of the three lighting modules 281, 282 and 283 overlap.

Figure 10:
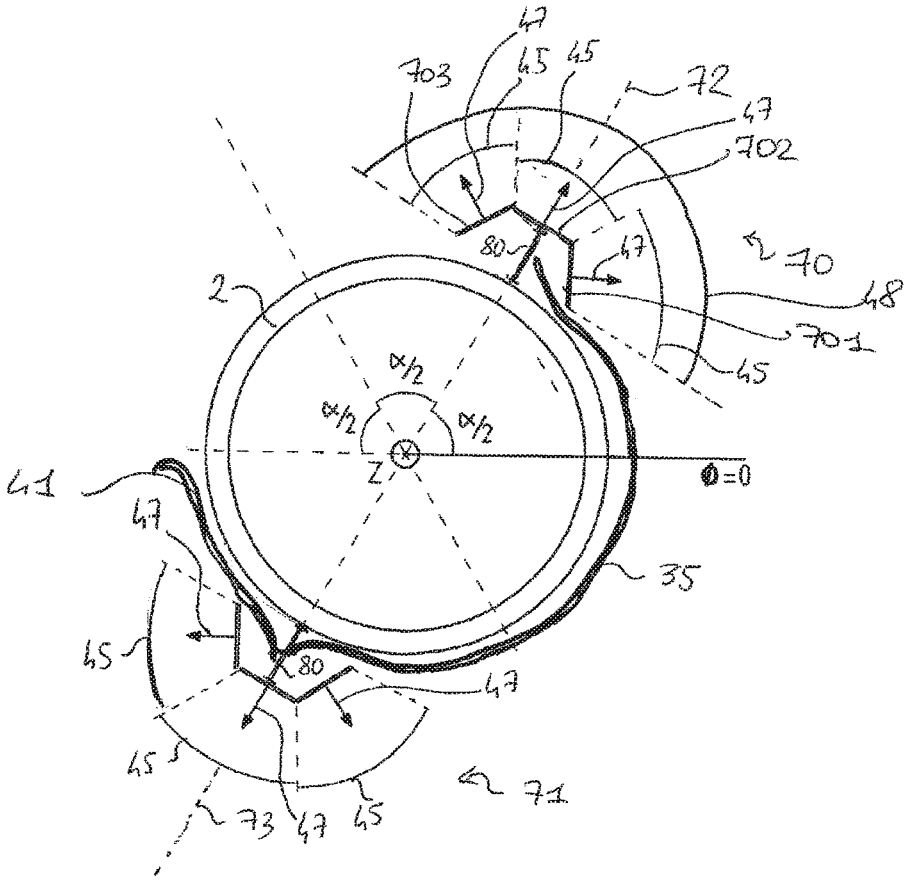
FIG. 10 schematically shows the azimuthal angular sectors of the projectors of the light-signaling system which comprises two modules of three projectors each.
Figure 11:
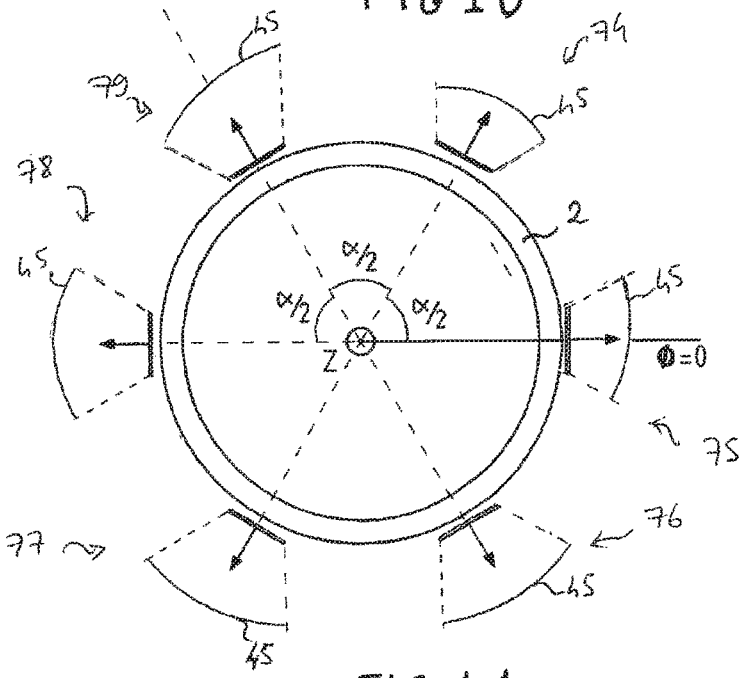
FIG. 11 schematically shows the azimuthal angular sectors of the projectors of the light-signaling system which comprises six modules of one projector each.

FIGS. 10 and 11 show variants of the light-signaling system 1.

FIG. 10 schematically shows a light-signaling system 1 which comprises two modules 70 and 71 each comprising three projectors 701, 702 and 703 which are similar to the projectors described above with reference to FIG. 9. The projectors 701, 702 and 703 of the module 70 are each oriented such that the main directions, represented by solid straight arrows 47, of two adjacent projectors form an angle of 60°.

The main directions 72 and 73 of the two modules are represented by dotted lines and separated from one another by an angle $\alpha=180°$. The elementary angular sectors 45 of the flat beams emitted by the projectors 701, 702 and 703 are greater than or equal to 60°. Thus, the lighting module 70 emits light within an azimuthal angular sector 48 that is greater than or equal to the sum of the elementary angular sectors 45, i.e. within an azimuthal angular sector 48 that is greater than or equal to 180°. The angular sector 48 of the lighting module 70 is centered on the main direction 72 of the lighting module 70.

The lighting module 70 is fixed to the chimney 2 by a fastening member 80, such that its main direction 72 extends in a radial direction from the chimney 2.

The module 71 has the same structure and the same geometry as the module 70, and is fixed to the chimney 2 such that its main direction 73 extends in the opposite radial direction.

Thus, a light-signaling system 1 according to this variant may also emit light in all azimuthal directions.

The lighting module 71 is defined as a main module and is connected to a main power supply cable 41 which is itself connected to a remote electrical power supply, at the base of the chimney 2, as shown schematically. For example, the main power supply cable 41 enters via the fastening member 80. The lighting module 70 is itself a secondary lighting module supplied with power by a secondary power supply cable 35 connected to the main lighting module. These electrical cables 35, 41 allow the light sources of the projectors 6 of each lighting module 70 and 71 to be supplied with power.

As a variant, it is also possible to envisage the secondary power supply cable being triplicated in order to supply power directly to each of the projectors 701, 702 and 703 of the secondary lighting module 70.

FIG. 11 schematically shows the geometry of the azimuthal elementary angular sectors 45 of projectors of a light-signaling system 1 according to one variant of the signaling system. The light-signaling system 1 includes six lighting modules 74, 75, 76, 77, 78 and 79. Each lighting module includes a projector similar to the projectors described above with reference to FIG. 9. Each lighting module 74, 75, 76, 77, 78 and 79 emits light within an elementary azimuthal angular sector 45 of 60°, which constitutes the azimuthal sector 45 of the projector of the lighting module. The bisectrices of the azimuthal angular sectors 45 form the main lighting directions of each of the six lighting modules, fixed around the chimney 2.

Thus, a light-signaling system 1 according to this variant may also emit light in all azimuthal directions.

One of the six modules is defined as a main module and is connected to a main power supply cable (not shown) which is itself connected to a remote electrical power supply, at the base of the chimney 2. Each of the other modules, referred to as secondary modules, is connected to this main module by a secondary power supply cable.

The light-signaling systems described above may be produced with numerous types of light sources, in particular LEDs, fluorescent tubes, discharge lamps and others. The light may be of different colors and may or may not flash, on the desired lighting characteristics.

In another embodiment, the linear light source is not centered exactly on the plane of symmetry 1000. Thus, the main direction of the elementary flat light beam is not exactly horizontal.

In another embodiment, the lens does not have a first plane of symmetry. In another embodiment, the lens does not have a second plane of symmetry.

The linear light source is preferably placed on a focal line of the cylindrical lens. The focal line is defined by a line on which light rays coming from infinity converge after having passed through the cylindrical lens in the opposite direction of propagation to that described above for the emission of the light of the projectors.

The cylindrical lens may be manufactured in numerous materials, for example glass, polycarbonate, transparent flexible resin, for example a flexible resin including polyurethane compounds, for example a resin of the series VT3402.

In another embodiment, the lighting modules may be stacked vertically, so that the light emitted by the light-signaling system is more intense.

The cylindrical lens may be of various shapes.

In another embodiment, the shape of the directrix curve is substantially that of a quadrilateral. In another embodiment, the directrix curve is elliptical. In another embodiment, the directrix curve is a circle.

In another embodiment, the cylindrical lens consists of an assembly of mutually coupled cylindrical lenses.

Although the invention has been described with regard to several particular embodiments, it is quite obvious that the invention is in no way limited thereto and that it comprises all the technical equivalents of the means described and also the combinations thereof provided that they fall within the scope of the invention.

The use of the verb "comprise" or "include" and the use of the conjugated forms thereof do not exclude the presence of elements or steps other than those mentioned in a claim. The use of the indefinite article "a" or "an" for an element or step does not exclude, unless mentioned otherwise, the presence of a plurality of such elements or steps.

In the claims, any reference sign between parentheses should not be interpreted as restricting the claim.

The invention claimed is:

1. A light-signaling system (1) comprising three lighting modules, in which:

each lighting module (28) comprises two projectors (6) being fixed together;

each projector (6) of the lighting module comprising:

an elongated cylindrical lens (7), the cylindrical shape of which is defined by a horizontal generatrix direction (10); and a linear light source (16) parallel to the horizontal generatrix direction (10), extending over all or part of a length of the cylindrical lens in order to emit a luminous flux (31) in a direction of the cylindrical lens;

the cylindrical lens being capable of generating a main flat light beam (26, 27) by concentrating the luminous flux within a predefined elevation (S) angular sector (3) around the horizontal generatrix direction in the direction of the space located on an opposite side of the cylindrical lens (7) with respect to the light source (16), and being capable of projecting the main flat light beam (26, 27) within a predefined elementary azimuthal angular sector around a vertical direction, the predefined elementary azimuthal angular sector (45) being greater than or equal to 60°;

each lighting module (28) being configured to illuminate within an azimuthal angular sector (450) smaller than or equal to the sum of the two elementary azimuthal angular sector(s) (45) of each of the two projector(s);

a bisectrix (432) of the azimuthal angular sector (450) of each lighting module defining a main direction of the lighting module (28), the lighting modules (281, 282, 283) being arranged such that the main directions (431, 432) of two adjacent lighting modules form between them an angle of 120°, such that the light-signaling system (1) is capable of emitting light around the light-signaling system (1) in all azimuthal directions (Φ), in which a first lighting module of the lighting modules (28) and a second lighting module of the lighting modules (28), are defined as secondary modules (43) and a third lighting module of the lighting modules (28), is defined as a main module (44), each of the secondary modules is connected by a power supply cable (35) to the main module, the main module itself being connected to a main power supply cable (41) that is capable of being connected to an electrical power supply in order to supply the projectors (6) of each lighting module (43, 44) with power, in which each lighting module (28) comprises a housing fixing the two projectors (6) together, in which the housing is horizontally substantially triangular in shape, a first side of the triangle (38) and a second side of the triangle (38) each being defined respectively by the respective generatrix direction of one of the two projectors (6) fixed to the housing and a third side being capable of being fixed to a support, in which the third side of one of the housings forms an angle of 60° with the third side of the other housings.

2. The system as claimed in claim 1, in which the azimuthal angular sector (45) of the main flat beam of a projector (6) is defined as the angular sector in which the luminous intensity is higher than 50% of the intensity present at the center of the main flat light beam (26, 27).

3. The system as claimed in claim 1, in which the projectors (6) of each lighting module (28) are fixed together at a respective longitudinal end of the projectors (6).

4. The system as claimed in claim 1, in which the projectors (6) of each lighting module (28) are positioned on a horizontal baseplate.

5. The system as claimed in claim 1, in which the elevation (S) angular sector is defined as the angular sector in which the luminous intensity is higher than 50% of the luminous intensity at the center of the flat light beam, the elevation angular sector being smaller than 10°.

6. The system as claimed in claim 1, in which the generatrix directions (10) of all of the cylindrical lenses of the system are in one and the same horizontal plane (5).

7. The system as claimed in claim 1, in which each of the lighting modules (28) is fixed to a tall obstacle (2) that must be signaled, the lighting modules (28) being oriented so as to emit light around the obstacle.

* * * * *